United States Patent [19]

Balz

[11] 4,110,085

[45] Aug. 29, 1978

[54] GLASS BONDED FINISHING MEDIA

[75] Inventor: Gunther W. Balz, Kalamazoo, Mich.

[73] Assignee: Roto-Finish Company, Kalamazoo, Mich.

[21] Appl. No.: 704,390

[22] Filed: Jul. 12, 1976

[51] Int. Cl.[2] ..... B24D 3/14

[52] U.S. Cl. ..... 51/308; 51/DIG. 30; 51/313

[58] Field of Search ..... 51/308, 307, DIG. 30, 51/313

[56] References Cited

U.S. PATENT DOCUMENTS

| | | | |
|---|---|---|---|
| 2,471,132 | 5/1949 | Wickman | 51/308 |
| 2,947,124 | 8/1960 | Madigan et al. | 51/308 |
| 3,089,764 | 5/1963 | Gorman | 51/308 |
| 3,549,341 | 12/1970 | Kittredge et al. | 51/308 |
| 3,679,382 | 7/1972 | Hack et al. | 51/308 |
| 3,702,758 | 9/1970 | Fukui et al. | 51/308 |

*Primary Examiner*—Donald J. Arnold
*Attorney, Agent, or Firm*—Gordon W. Hueschen

[57] ABSTRACT

The application discloses abrasive finishing chips suitable for use as abrasive media in finishing processes and apparatus for the finishing of parts and workpieces, comprising abrasive grains dispersed in a matrix comprising at least 50% by weight of ground glass bonded together with a substantially uniform bond and of a shape suitable for employment as an abrasive media chip, and a process for the production of such chips which comprises the steps of providing ground glass, causing abrasive grains to be dispersed therein, subjecting the mixture to shape-forming procedure, heating the same to the sintering point of the ground glass, that is, at a temperature between the softening point and the working (fluid) point of the glass but below 1950° F., and allowing the same to cool, thereby to produce abrasive media chips to the type aforesaid.

23 Claims, 4 Drawing Figures

GLASS BONDED FINISHING MEDIA

BACKGROUND OF INVENTION

1. Field of Invention

Abrasive media for use in finishing processes and in finishing machines of the vibratory or tumbling-barrel types for the finishing, e.g., deburring, burnishing, edge-breaking, and polishing of parts or workpieces therein.

2. Prior Art

Numerous types of finishing media have been proposed over the years for finishing processes and for use in finishing machines of the type here concerned. Such finishing media generally comprise loose aggregate integral units, generally referred to as finishing "chips". The earliest finishing material was loose rock aggregate, but advances in the art have provided numerous types of finishing media and chips wherein various types of abrasive grains are imbedded in a variety of binders, among the most recent of which is a ceramic type of binder. Other types of binders or cores, more properly referred to as a "matrix", have included soft metals, ice, plastics of various types, and waxes, with varying degrees of success. The most popular finishing media at present have a resin-bonded or ceramic matrix containing abrasive grains dispersed therein. Such ceramic abrasive media have traditionally been provided in pre-formed shapes, wherein the ceramic-abrasive mixture is integrally bonded by the procedure employed. After providing the traditional pre-formed shapes, they are usually dried at relatively high temperatures, approximately 700° F., for a period of up to 45 hours, and then fired at temperatures above the sintering temperature, such as 1900° to 2700° F., for additional periods of up to 20 hours. Although adequate in practice, the cost of fuel, e.g., gas or electricity, for providing the necessary high temperatures in such processing has become prohibitively expensive. It is apparent that improved abrasive media which are satisfactory for the intended purposes of employment in finishing processes and finishing apparatus, which perform as well as or better than existing ceramic media in terms of wear rate or depreciation, and which obviate the necessity of the employment of such high temperatures and the attendant high fuel consumption, would be highly desirable.

SUMMARY OF THE INVENTION

The present invention relates to abrasive media for use in finishing processes and apparatus which perform as well as or better than existing high-cost ceramic media in terms of wear rate or depreciation. The same comparison can be made between the abrasive media of the present invention and other high-temperature media which are not of a ceramic nature, e.g., aluminum oxide nuggets. According to the present invention, ground glass in particulate form from glass having a working temperature below 1950° F. is admixed with the selected abrasive, extruded, molded, or pressed into suitable forms, and sintered at a temperature between the softening point and the working point of the glass. The temperatures involved are greatly reduced when compared with those required for the preparation of previously-employed high-temperature media, and the product is superior in practice so far as wear rate or depreciation, a most important economic characteristic of a suitable abrasive medium for surface finishing. Not only are the temperatures required for the process of the present invention greatly reduced as compared with temperatures required for production of previously-available high-temperature media, but the time of drying and firing is likewise greatly reduced, thereby imparting further economy to the process. The lower the softening point of the glass employed, the greater the economy achieved, as a general principle. Generally greater economies are achieved by the employment of lower softening point glass inasmuch as the sintering temperature can in such cases be maximally reduced, but these advantages in temperature and fuel reduction reach a point where the economies thereof are offset by the greater expense of such lower softening point glasses, so that no economic advantage is achieved below a certain minimum softening point glass unless scrap for recycling is available.

Particular advantage is obtained in abrasive media prepared as described above in which the ratio of glass to abrasive is greater than about 1 and preferably on the order of about 1.5 to about 1.

OBJECTS

It is an object of the present invention to provide novel and advantageous abrasive media for use in finishing processes and apparatus, and a process for the preparation thereof. An additional object is the provision of such advantageous abrasive media and process in which the matrix comprises ground glass substantially uniformly bonded to itself and to the abrasive grains dispersed therein, having the aforesaid advantageous ratio of glass to abrasive. A further object is to provide such abrasive media and process wherein the said bonding is effected by sintering of the ground glass at a suitable temperature. An additional object of the invention is to provide such novel abrasive media and process wherein the sintering is effected at a temperature at or below 1950° F. Other objects will become apparent hereinafter and still others will readily present themselves to one skilled in the art to which this invention appertains.

DETAILED DESCRIPTION OF THE INVENTION

Figure 1:
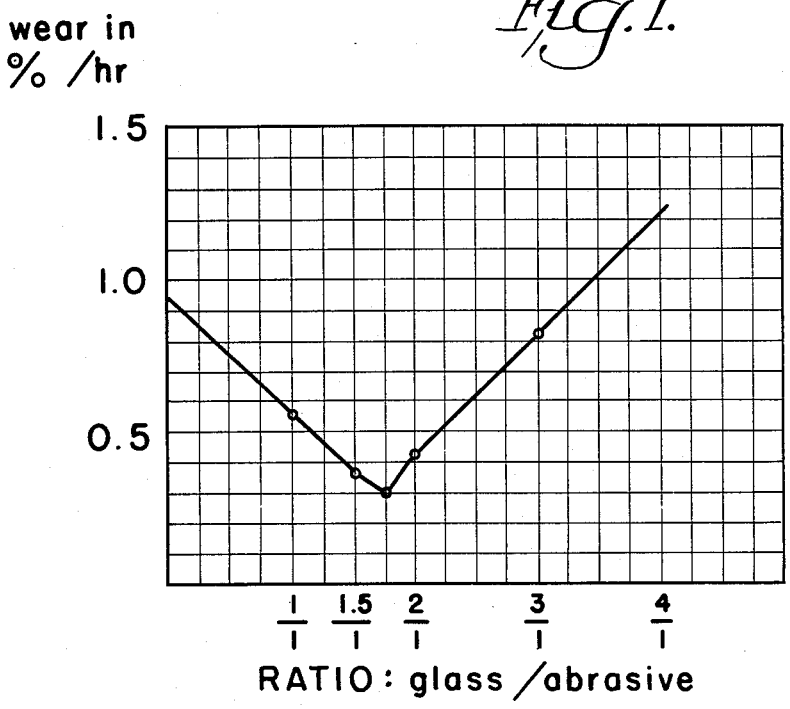
FIGS. 1, 2, 3, and 4 are graphs showing the rate of wear as a function of the ratio of glass to abrasive.

According to the present invention, abrasive media suitable for employment in usual vibratory or tumbling finishing processes and apparatus is provided in the form of abrasive grains substantially and preferably relatively uniformly dispersed throughout a ground glass matrix which is substantially uniformly bonded to itself and to the abrasive grains therein by sintering at or below a temperature of 1950° F. for a sufficient period to effect the said sintering and produce the said bond. This presents no problem in practice, as sintering generally commences substantially at the softening point of the ground glass, and it is not necessary to increase the temperature to the working point of the glass.

Any suitable glass may be employed. Sodalime glasses are satisfactory, and are preferred because of their economy. Discarded bottles and glass scrap provide a suitable source of the ground glass for use in the process of the invention. This can of course be recycled to provide an extremely inexpensive source of glass. One typical sodalime glass has a softening point of approximately 1285° F. and a working point of approximately 1841° F; another, 1437° and 1808° F., respectively; and still another, 1330° and 1725° F, respectively. It is not necessary and it is generally not desirable from an economic standpoint to heat the sodalime glass in its ground or granulated form entirely up to its working point. Glass having a softening point as low as 824° F. and a working point of approximately 1036° F., generally known as "high-lead" glass, is also suitable, and provides a greater economic advantage due to the fact that its softening point is as low as 824° F., requiring considerably less fuel for the softening and sintering of the granulated or particulate form thereof employed according to the invention, but unfortunately its greater cost factor goes far to offset advantages of the process which can be effected due to reduction of necessary temperatures employed in the process with their corresponding economy in fuel consumption.

The abrasive employed according to the present process and embodied in the abrasive media of the invention can be any conventional type, and may include, for example, silica, aluminum oxide, silicon carbide, boron carbide, or grains of any other substance of an abrasive nature, including small rock grains, or mixtures thereof. The exact type of abrasive grain employed according to the present invention is not critical, aside from the obvious point that it must not interfere with the formation of a substantially uniform bond between and among the particles of ground glass at or above the sintering temperature and integral bonding of the abrasive grains within the sintered and thus re-established glass matrix.

The amount of abrasive can range from about 10 to about 50% and, advantageously, is about 30%. Advantageous wear rate or depreciation characterizes the product of the invention within these ranges.

As already stated, any suitable glass may be employed in the process and in the production of the abrasive media of the invention provided it has a working point below 1950° F. The lower the softening point of the glass, the lower the temperature of the sintering which can be employed, thus imparting even further economies to the process within the limits of practicality of the cost factor of the glass employed in the process. The most suitable source of starting glass would be scrap high-lead glass, from the standpoint of low melting and sintering temperature, but such is difficult to find, so that discarded bottle glass and scrap, usually of a sodalime nature, is generally preferred and is entirely satisfactory for the intended purpose. Commercial sources of ground glass exist. Other types of glass, having softening points and working points below 1950° F. may also be employed, and these include potash-lead glass, potashsoda-lead glass, sodazinc glass, aluminosilicate glass, borosilicate glass, sodium barium glass, sodium barium borosilicate glass, and the like, with the understanding that the greatest economies are of course effected by using the lower softening point glass within the limits of the economy associated with its availability.

The size range of the abrasive employed is not critical. Usual size ranges are suitable. From one (1) micron up to 1/16-inch in diameter, or a mixture of various size grains, may be employed. Uniformity of grain size is preferred, but not essential.

The ratio of glass to abrasive is greater than about 1 as below this ratio excessive wear rates obtain. Advantageously, the ratio is on the order of about 1.5 to about 1, as within this range optimum wear rate is obtained.

In general, the process involves admixing a ground glass having a working point below 1950° F. with abrasive grains and any other desired but optional ingredient, extruding, molding, or pressing the mixture into pre-selected shapes, and heating the mixture at or about the sintering point of the ground glass. The grains of abrasive end up dispersed and bonded within and bonded to the sintered glass. The starting glass particles may be of any suitable particle size, the smaller the size the more rapid the sintering of the glass and the easier and more complete the dispersion of abrasive grains therein. A mesh size greater than 40 (U.S. mesh size), advantageously greater than approximately 80, may be satisfactorily employed. Greater than 100 is preferred. Screened ground glass, for example, where the coarse particles are screened out with a 200 mesh screen, are of particular advantage. The admixture of ground glass and abrasive grains may be extruded in the form of sheets, tubes, or bars, and may be pressed, or formed or cast into shapes in molds (which may be permanent or consumable during the subsequent firing), so as to provide a green or raw abrasive media chip in forms suitable for conversion by heating, and subsequent cooling, into finished chips for employment in finishing processes and apparatus. Such shapes may obviously be as conventional in the art to date, namely, squares, rectangles, cylinders, tubes, pyramids, cones, or the like. The shape-forming procedure is preferably carried out cold and before the extrudate, moldate, or pressate is completely dry and of course before it is fired, so as to facilitate and generally make easier the shape-forming operation.

In the drying step, it has been found that temperatures not in excess of 200° F. are entirely suitable, and in no case has it been necessary that the drying be carried out at any temperature greater than 350° F. for a period of 12 hours. Drying operations of a completely satisfactory nature according to the present invention employ a temperature of 200° F. and a period of 6 hours.

The firing operation, again advantageously, has in no case required more than 2 hours or a temperature greater than 1950° F. In satisfactory operation according to the invention, the firing may be for approximately 1 hour at a temperature of approximately 1650° F.

If desired, further additaments may be introduced into the mixture of glass and abrasive grains, for purposes of providing inexpensive filler, improving surface characteristics of the parts being finished, or provide desirable fabricating or use characteristics, according to the established knowledge of the art. For example, they may be added to provide desirable green-strength qualities and desirable surface characteristics upon utilizing the abrasive media product in a finishing operation. To this end, fine finishing materials such as pumice, diatomaceous earth, rouge, alumina, and the like, may also advantageously be incorporated into a ground glass and abrasive grain mixture, if desired. Moreover, suspending agents and/or plasticizers may also be advantageously introduced into the mixture of ground glass and abrasive grains. Commercially available fine clays, such as those sold under the trade name of "Volclay", may advantageously be employed for this purpose.

According to a preferred aspect of the invention, water or other binder such as a silicate, wax, or the like, may be added to the mixture of ground glass and abrasive grains to increase the green-strength thereof and facilitate the shape-forming procedure prior to drying and firing. This material is preferably of a nature such that it is expelled at the temperatures employed for drying and firing of the chips. Any material which serves the purpose of increasing green-strength, facilitating dispersal of abrasive grains, or facilitating the shape-forming procedure, and which is largely expelled during the drying and firing procedure, may be employed to advantage. Even such materials which are not largely expelled during the drying and firing procedure may be employed to the extent that such are available, do not interfere with the ultimate end use of the finishing chip, and are economically feasible. The binder preferably comprises an inexpensive liquid such as water.

Although the addition of water or the like to the green or starting mixture of ground glass and abrasive grains is not essential, addition of a small amount of water has been found advantageous. It appears to facilitate dipersal of the abrasive grains, provide a somewhat more readily formable, e.g., extrudable, intermediate mixture, and is at any rate largely expelled from the final abrasive media chip product during the drying and firing procedure. Up to approximately 10% by weight of water has been added with no noticeable untoward effects in processing or in the product produced, and approximately 8% by weight of water may generally be employed to advantage.

The tests employed for determining depreciation of the finishing chips of the invention were all run according to standard procedure and in a standard oscillating machine. The depreciation was determined by oscillating the chips being tested with chips of the same type and measuring the amount of depreciation that occurred over a specified period.

The following examples are given by way of illustration only and are not to be construed as limiting. Parts, percentages, and ratios are by weight unless otherwise specified.

EXAMPLE 1

Common sodalime-glass scrap, comprising mainly old bottle glass, is collected and reduced in size to particles of approximately 80 mesh size (U.S. standard). Grains of silica of approximately 50 microns in diameter on their greatest diameter are added, along with water, and water glass, to provide a mixture comprising 58% of ground glass, 32% of abrasive grains, 8% water, and 2% water glass, all by weight of the total mixture. The ratio of glass to abrasive is 1.8:1.

The mixture is then extruded in the form of cylindrical bars of ¼-inch diameter, which are cut into chips of 1-inch lengths. The chips are dried at 200° F. for 15 hours and then fired at 1650° F. for a period of one hour and subsequently allowed to cool. The grains of the abrasive become dispersed throughout the ground glass and the glass becomes substantially uniformly bonded to itself and to the abrasive grains throughout the chip.

In other operations, the mixture is cast into molds or dropped onto a flat plate, in either case resulting in the formation of raw or green chips having the approximate form of cones of the desired height and width, e.g., one inch in height and approximate base diameter of one inch. In still another operation, immediately after extrusion, the cylindrical bar upon extrusion is cut into approximately one inch long cylinders having oblique ends by means of an approximately 45° angle shear. In each case, after the shape-forming operation, the abrasive media, now in the form of chips, is subjected to drying in an oven at 200° F. for a period of 6 hours, and is then fired in a gas-fired furnace for 1 hour at a temperature of 1650° F.

After drying and firing, and thereafter allowing to cool, the abrasive media chips are collected and employed in the finishing of parts, for example, aluminum, zinc, steel, or plastic workpieces, in a Spiratron TM vibratory finishing machine and are found satisfactory for such purposes. The finishing chips provide a completely adequate cut rate and do not exhibit any observable unacceptable wear characteristics. In their performance and depreciation, they are entirely comparable to the best high-temperature high-cost ceramic-bonded abrasive media presently commercially available in the field.

EXAMPLE 2

The process of Example 1 is repeated, this time employing approximately 10% by weight water, 60% ground glass, and 30% abrasive grains. A small amount of sodium silicate is also added. The results are comparable.

EXAMPLE 3

The process of Example 1 is repeated, this time employing 62% by weight of ground glass, 30% a mixture of aluminum oxide and silicon carbide abrasive grains, approximately 7% by weight of water, and the remainder being Volclay TM fine clay used as a suspending agent and plasticizer.

The product is suitable for the intended purpose, and gives a desirable fabricating quality to the parts, namely, a somewhat smoother brighter surface than attained in the finishing procedure reported under Example 1.

FURTHER FORMULATIONS (BY WEIGHT)

EXAMPLE 4

| | Percent |
|---|---|
| Ground glass (sodalime) | 60.0 |
| Silica (SBB; 300 US mesh crystalline) | 30.0 |
| Volclay(TM) (commercial fine clay suspending agent and plasticizer) | 4.0 |
| $H_2O$ | 6.0 |

Press cones ¾ inch × 1 inch

Dry overnight at 180° F.

Fire 1.25 hours at 1650° F. maximum (raise temperature gradually from 200° to 1650° F. over 1.25-hour period and then turn heat off. Allow chips to cool down for two hours).

Results: Appearance good. Bond tight.

Depreciation test: 0.1%/hr. in high-speed tests run for 18¾ hours.

Finishing of parts with a plurality of cones of this type in a vibratory finishing machine produces a highly satisfactory result.

EXAMPLE 5

| | Percent |
|---|---|
| Ground glass (sodalime) | 60.0 |
| Silica (SBB) | 20.0 |
| 325 Limalox(TM) ($Al_2O_3$ abrasive grains) | 12.0 |
| $H_2O$ | 8.0 |

Press cones ¾ inch × 1 inch

Dry at 210° F. for 16 hours.

Fire for one hour at 1650° F. maximum.

Results: Appearance good. Tight bond. Finishing of parts with a plurality of cones of this type in a vibratory finishing machine produces a highly satisfactory result. Depreciation is not measurable after 19.25 hours in high-speed tester.

EXAMPLE 6

Formula of Example 2: 74.5 grams
Volclay TM : 4.0 grams
The mixture is moistened with water and cones ¾ inch × 1 inch are pressed.
Dry at 210° F. for 22 hours
Fire for one hour at 1650° F. maximum.
Results: Appearance good.
Depreciation: less than 0.1%/hr. after 22.75 hours in high-speed tester. Finishing of parts with a plurality of cones of this type in a vibratory finishing machine produces a highly satisfactory result. Note: Green-strength was improved by addition of Volclay TM.

EXAMPLE 7

| | Percent |
|---|---|
| Amorphous silica | 30.0 |
| Ground glass (sodalime) | 63.0 |
| Sodium silicate (S-35) (diluted 2:1 with $H_2O$) | 7.0 |

Dry 3.5 hours at 220° F.
Fire 1.25 hours at 1650° F. maximum. Cool.
Results: Appearance good. Depreciation less than 0.1%/hr. after 29.5 hours in high-speed tester. Finishing of parts with a plurality of cones of this type in a vibratory finishing machine produces a highly satisfactory result.

EXAMPLE 8

| | Percent |
|---|---|
| Silica (SBB) | 30.0 |
| Ground glass (sodalime) | 63.0 |
| Sodium silicate (S-35) (diluted 2:1 with $H_2O$) | 7.0 |

Press cones ¾ inch × 1 inch
Air dry at room temperature overnight.
Fire at 1650° F. maximum for total cycle of one hour up to temperature.
Results: Appearance good. Depreciation 0.1%/hr. after 72.25 hours in high-speed tester. Finishing of parts with a plurality of cones of this type in a vibratory finishing machine produces a highly satisfactory result.

Figure 2:
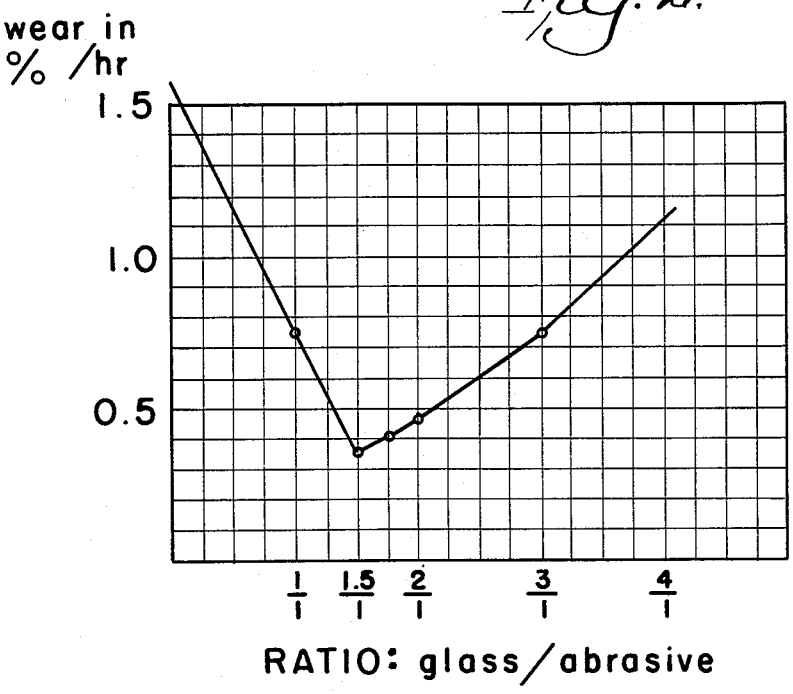
Figure 3:
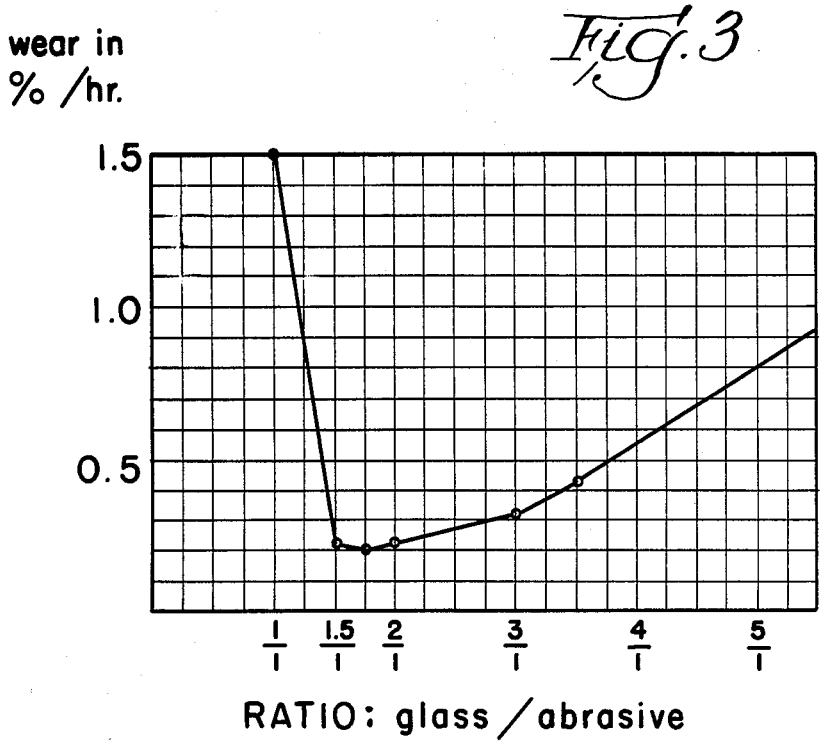
Figure 4:
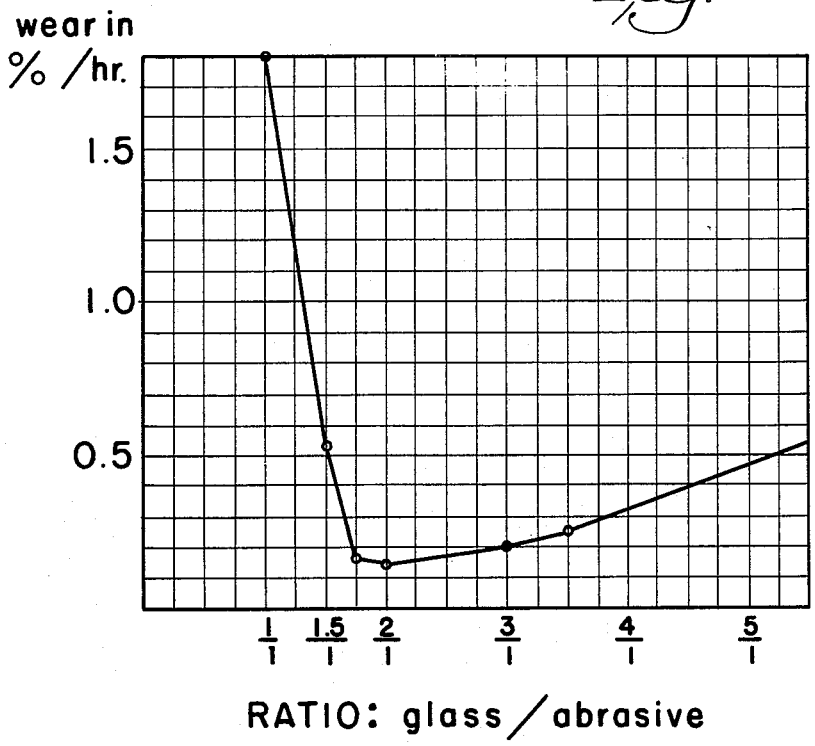

In FIGS. 1, 2, 3, and 4 there is illustrated wear tests performed with abrasive chips prepared by the process of Example 1, except that they were fired for 2 hours and prepared from the materials and in the proportions given in the following series.

I SERIES: (FIG. 1)

| | X-80 / SBB | | | | | | | | | |
|---|---|---|---|---|---|---|---|---|---|---|
| Ratios | 1:1 | | 1.5:1 | | 1.75:1 | | 2:1 | | 3:1 | |
| Components | gm | % | gm | % | gm | % | gm | % | gm | % |
| X-80 | 35 | 32.9 | 42 | 39.1 | 44 | 41.2 | 46.7 | 43.4 | 52.5 | 48.4 |
| SBB | 35 | 32.9 | 28 | 26.0 | 25.1 | 23.5 | 23.3 | 21.7 | 17.5 | 16.1 |
| VC 200 | 1.5 | 1.4 | 1.5 | 1.4 | 1.5 | 1.4 | 1.5 | 1.4 | 1.5 | 1.4 |
| $H_2O$ | 35 | 32.9 | 36 | 33.5 | 36 | 33.8 | 36 | 33.5 | 37 | 34.1 |

II SERIES: (FIG. 2)

| | X-80 FINES / SBB | | | | | | | | | |
|---|---|---|---|---|---|---|---|---|---|---|
| Ratios | 1:1 | | 1.5:1 | | 1.75:1 | | 2:1 | | 3:1 | |
| Components | gm | % | gm | % | gm | % | gm | % | gm | % |
| X-80F | 35 | 32.6 | 42 | 39.4 | 44 | 41.3 | 46.7 | 44.7 | 52.5 | 50.2 |
| SBB | 35 | 32.6 | 28 | 26.3 | 25.1 | 23.5 | 23.3 | 22.3 | 17.5 | 16.7 |
| VC 200 | 1.5 | 1.4 | 1.5 | 1.4 | 1.5 | 1.4 | 1.5 | 1.4 | 1.5 | 1.4 |
| $H_2O$ | 36 | 33.5 | 35 | 32.9 | 36 | 33.8 | 36 | 34.4 | 36 | 34.4 |

III SERIES: (FIG. 3)

| | X-80 FINES/S MICRON | | | | | | | | | | | |
|---|---|---|---|---|---|---|---|---|---|---|---|---|
| Ratios | 1:1 | | 1.5:1 | | 1.75:1 | | 2:1 | | 3:1 | | 3.5:1 | |
| Components | gm | % | gm | % | gm | % | gm | % | gm | % | gm | % |
| X-80F | 35 | 32.3 | 42 | 39.8 | 44 | 41.9 | 46.7 | 44.1 | 52.5 | 50.2 | 54.5 | 51.4 |
| S Micron | 35 | 32.3 | 28 | 26.5 | 25.1 | 23.9 | 23.3 | 22.0 | 17.5 | 16.7 | 15.5 | 14.6 |
| VC 200 | 1.5 | 1.4 | 1.5 | 1.4 | 1.5 | 1.4 | 1.5 | 1.4 | 1.5 | 1.4 | | |
| $H_2O$ | 37 | 34.1 | 34 | 32.2 | 34.5 | 32.8 | 34.5 | 32.5 | 34 | 32.5 | 34.5 | 32.5 |

Press cones ¾ inch × 1 inch.

IV SERIES: (FIG. 4)

| | X-80/S MICRON | | | | | | | | | | | |
|---|---|---|---|---|---|---|---|---|---|---|---|---|
| Ratios | 1:1 | | 1.5:1 | | 1.75:1 | | 2:1 | | 3:1 | | 3.5:1 | |
| Components | gm | % | gm | % | gm | % | gm | % | gm | % | gm | % |
| X-80 | 35 | 33.0 | 42 | 39.6 | 44 | 42.3 | 46.7 | 44.1 | 52.5 | 49.5 | 54.5 | 51.4 |
| S Micron | 35 | 33.0 | 28 | 24.6 | 25.1 | 24.1 | 23.3 | 22.0 | 17.5 | 16.5 | 15.5 | 14.6 |
| VC 200 | 1.5 | 1.4 | 1.5 | 1.4 | 1.5 | 1.4 | 1.5 | 1.4 | 1.5 | 1.4 | 1.5 | 1.4 |
| $H_2O$ | 34.5 | 32.5 | 34.5 | 32.5 | 34.5 | 33.1 | 34.5 | 32.5 | 34.5 | 32.5 | 34.5 | 32.5 |

X-80 was ground glass (sodalime) supplied by Harshaw Chemical Company having the following properties:

| Typical analysis | Percent |
|---|---|
| $SiO_2$ | 72 |
| $Na_2CO_3$ | 18 |
| CaO | 4 |
| MgO | 3 |
| $K_2O$ | 2 |
| Pb | <1 |
| Mesh analysis: 68% through 200 mesh screen (U.S. Standard) | |
| Softening point 1437° F., Working (fluid) 1808° F | |

X-80F is the fines of X-80, i.e., the part passing a 200 mesh screen. SBB is Silver Bond "B" grade of crystalline silica supplied by Tammsco, Inc. S Micron is S Micron grade of amorphous silica sold by Tammsco, Inc. VC 200 is Volclay TM The chips were wear-tested in a test vibrator. They were sandcast tetrahedrons which were dried at 180° F. for ½ hour before de-molding and 3 hours at 180° F. after de-molding. The wear tests were then run on 4 chips each test in 1% solution of liquid soap at a 20% flow rate. All tests were run at least 15 hours after which the weight loss due to the wear was determined.

These results show that wear loss is at a nadir at a ratio of glass to abrasive of about 1.5:1 and that it tends to rise sharply when the ratio of glass to abrasive is more than 1.5:1. The data also show that when ground glass fines, that is, the part of the ground glass passing a 200 mesh screen, is used, the rise in the wear rate below a ratio of 1.5:1 is very rapid, whereas the increase in wear rate at ratios above 1.5:1 is very slow. Thus, when abrasive is dispersed in a matrix of sintered glass, unique results are obtained when the ratio of glass to abrasive is above 1 or 1.5:1, and particularly critical results are obtained when the coarser particles are screened from the ground glass and only the fines are used. The data show a critical range of 1.5:1 to 2:1 in all cases, and a critical range of from 1.5:1 to 3.5:1 or higher, when screened ground glass is used.

Although the term "sintering" has been used throughout in its usual sense of causing a material, here glass, to become a coherent imporous mass by heating without melting, so that the sintering point or range is generally close to and just above the softening point or range, it should be clear that temperatures above the sintering or softening point or range and even up to the working point or range may be employed, if desired, although sacrifice of economy will obviously be incurred as a result of the employment of such higher temperatures.

It is to be understood that the invention is not to be limited to the exact details of operation or exact compounds, compositions, methods, or procedures shown and described, as obvious modifications and equivalents will be apparent to one skilled in the art.

I claim:

1. An abrasive finishing chip suitable for use as an abrasive medium in finishing processes and apparatus for the finishing of parts and workpieces, comprising abrasive grains dispersed in a matrix of sintered ground glass having a working point below about 1950° F. with a glass to abrasive weight ratio of about 1:1 to about 3.5:1 and of a shape suitable for employment as an abrasive media chip.

2. An abrasive media chip of claim 1, wherein the ratio of glass to abrasive grains is about 1.5:1 to about 2:1.

3. An abrasive media chip of claim 1, wherein the ground glass before sintering will pass a 200 mesh screen.

4. An abrasive media chip of claim 3, wherein the ratio of ground glass to abrasive is at least about 1.5:1.

5. An abrasive media chip of claim 4, wherein the glass to abrasive ratio is about 1.8:1.

6. An abrasive media chip of claim 1, wherein the glass has a softening point not greater than about 1450° F.

7. An abrasive media chip of claim 1, wherein the glass is sodalime glass.

8. An abrasive media chip of claim 7, wherein the glass before sintering is screened on a 200 mesh screen to remove coarse particles.

9. An abrasive media chip of claim 1, wherein the abrasive is present in the amount of at least 10% by weight of the total composition.

10. An abrasive media chip of claim 6, wherein the abrasive is present in the amount of at least 10% by weight of the total composition.

11. A process for the production of abrasive media chips suitable for use in finishing processes and apparatus for the surface finishing of parts and workpieces, comprising the steps of providing ground glass having a working point below about 1950° F., causing abrasive grains to be dispersed therein in a glass to abrasive weight ratio of about 1:1 to about 3.5:1 subjecting the mixture to a shape-forming procedure, sintering the same to a temperature between the softening point and the working point of the ground glass, and allowing the same to cool, thereby to produce abrasive media chips.

12. A process of claim 11, wherein, the ratio of glass to abrasive grains is about 1.5:1 to about 2:1.

13. A process of claim 11, wherein the ground glass before shape forming will pass a 200 mesh screen.

14. A process of claim 11, wherein the ratio of ground glass to abrasive is at least about 1.5:1.

15. A process of claim 11, wherein the glass to abrasive ratio is about 1.8:1.

16. A process of claim 11, wherein the glass has a softening point not greater than about 1450° F.

17. A process of claim 11, wherein the ground glass comprises ground sodalime glass.

18. A process of claim 17, wherein the glass before shape forming is screened on a 200 mesh screen to remove coarse particles.

19. A process of claim 11, wherein the sintering step comprises drying at a temperature no greater than about 350° F. for a period no greater than about 12 hours and firing for a period no greater than about two hours at a temperature no greater than about 1950° F.

20. A process of claim 19, wherein the drying is carried out at a temperature of approximately 200° F. for approximately 6 hours and the firing is carried out at a temperature of about 1650° F. for approximately one hour.

21. A process of claim 11, wherein the abrasive is present in the amount of at least 10% by weight of the total composition.

22. A process of claim 15, wherein the abrasive is present in the amount of at least 10% by weight of the total composition.

23. A process of claim 11, wherein up to approximately 10% by weight of water is included in the mixture of ground glass and abrasive grains.

* * * * *

UNITED STATES PATENT AND TRADEMARK OFFICE

CERTIFICATE OF CORRECTION

PATENT NO. : 4,110,085

DATED : August 29, 1978

INVENTOR(S) : Balz

It is certified that error appears in the above-identified patent and that said Letters Patent are hereby corrected as shown below:

Col. 8, line 1; "220° F." should read --200° F.--

Col. 8, Example 8, third series, line 3; "3.5:1" is not underlined. It should read --3.5:1--

Col. 8, Example 8, third series, line 7, under Column Ratio's 3.5:1, components gm and % are blank. Component gm should read --1.5-- and Component % should read --1.4--

Signed and Sealed this

*Thirteenth* Day of *March 1979*

[SEAL]

*Attest:*

RUTH C. MASON
*Attesting Officer*

DONALD W. BANNER
*Commissioner of Patents and Trademarks*